US006467191B2

(12) United States Patent
Hayashi et al.

(10) Patent No.: US 6,467,191 B2
(45) Date of Patent: Oct. 22, 2002

(54) AIR VENTILATION STRUCTURE OF SHOE SOLE

(75) Inventors: Tomohiro Hayashi, Kobe (JP); Minoru Tanaka, Kobe (JP)

(73) Assignee: AS/CS Corp., Kobe (JP)

( * ) Notice: Subject to any disclaimer, the term of this patent is extended or adjusted under 35 U.S.C. 154(b) by 0 days.

(21) Appl. No.: 09/888,325

(22) Filed: Jun. 19, 2001

(65) Prior Publication Data

US 2002/0017037 A1 Feb. 14, 2002

(30) Foreign Application Priority Data

Jun. 23, 2000 (JP) ..... 2000-188717

(51) Int. Cl.[7] ..... A43B 7/06; A43B 13/20
(52) U.S. Cl. ..... 36/3 B; 36/29
(58) Field of Search ..... 36/3 R, 3 B, 59 A, 36/134, 133, 136, 8.1, 28, 29, 30 R

(56) References Cited

U.S. PATENT DOCUMENTS

| | | | | |
|---|---|---|---|---|
| 80,931 A | | 9/1868 | Ferry | |
| 904,891 A | | 11/1908 | Otterstedt | |
| 1,202,827 A | * | 10/1916 | Gerhold | 36/3 B |
| 1,203,694 A | * | 11/1916 | Brower | |
| 2,030,545 A | | 2/1936 | Schulze | |
| 2,358,342 A | | 9/1944 | Margolin | |
| 2,479,793 A | | 8/1949 | Tarlow | |
| 2,884,716 A | | 5/1959 | Shelare et al. | |
| 3,324,578 A | | 6/1967 | Brutting | |
| 3,383,782 A | | 5/1968 | McGinnity | |
| 3,492,744 A | | 2/1970 | Bernier et al. | |
| 4,063,371 A | | 12/1977 | Batra | |
| 4,100,685 A | | 7/1978 | Dassler | |
| 4,290,211 A | | 9/1981 | Csengeri | |
| 4,438,573 A | | 3/1984 | McBarron | |
| 4,507,880 A | | 4/1985 | Ohashi | |
| 4,525,940 A | | 7/1985 | Mochizuki | |
| 4,571,853 A | | 2/1986 | Medrano | |
| 4,674,200 A | | 6/1987 | Sing | |
| 4,742,625 A | | 5/1988 | Sydor et al. | |
| 4,771,555 A | * | 9/1988 | Ohashi | 36/3 R |
| 4,885,851 A | | 12/1989 | Peterson | |
| 4,888,887 A | | 12/1989 | Solow | |
| 4,894,932 A | | 1/1990 | Harada et al. | |
| 5,392,533 A | * | 2/1995 | Gerhartl | 36/3 B |
| 5,458,348 A | * | 10/1995 | Lee | 36/3 R |
| 5,588,226 A | | 12/1996 | Schenkel | |
| 5,642,575 A | | 7/1997 | Norton et al. | |
| 5,845,418 A | | 12/1998 | Chi | |
| 5,983,524 A | | 11/1999 | Polegato | |
| 5,983,525 A | | 11/1999 | Brown | |
| 6,014,821 A | | 1/2000 | Yaw | |
| D431,896 S | | 10/2000 | Belfanti | |

FOREIGN PATENT DOCUMENTS

| | | |
|---|---|---|
| JP | 1-143904 | 10/1989 |
| JP | 7-327706 | 12/1995 |
| JP | 8-24003 | 1/1996 |
| JP | 8-89307 | 4/1996 |
| JP | 10-248604 | 9/1998 |
| JP | 11-137302 | 5/1999 |

* cited by examiner

*Primary Examiner*—Anthony D. Stashick
(74) *Attorney, Agent, or Firm*—Michael Zall

(57) ABSTRACT

A ventilation structure of a shoe sole of the present invention includes the shoe sole (1) formed with a through hole (5) vertically passing therethrough. The through hole (5) is fitted with a ventilation part (6). The ventilation part (6) comprises a flange portion (60) and the projection (61). The flange portion (60) engages the upper surface **(2*a*) of the shoe sole (1) so that the ventilation part (6) does not drop off the through hole (5). The projection (61) extends into the through hole (5). The projection (61) is provided with a vent hole (62)** vertically passing therethrough for the passage of air.

10 Claims, 7 Drawing Sheets

AIR VENTILATION STRUCTURE OF SHOE SOLE

BACKGROUND OF THE INVENTION

1. Field of the Invention

The present invention relates to an air ventilation structure for a shoe sole, and more specifically to an athletic shoe suitable for running, triathlon, and the like.

2. Description of the Related Art

The shoe sole is formed with a hole for air ventilation or drainage for preventing a foot from being hot and humid in the shoe is known.

FIG. 4 shows a structure of a shoe sole disclosed in Japanese Utility Model Laid-Open No. 143904/1989.

As shown in FIG. 4, the shoe sole 101 is formed with a number of vent holes 102. Each vent hole 102 has a hole diameter increasing toward the bottom in a tapered shape. Such shape allows foreign matter 103, such as a pebble, to drop off when clogged therein. However, even when the vent hole 102 is formed into such a tapered shape, the foreign matter 103 cannot drop off so easily. This results in the lowering of air ventilating and draining capabilities.

FIG. 5 shows a structure of a shoe sole disclosed in U.S. Pat. No. 904,891.

In FIG. 5, the shoe sole 101 supports an inner sole 105 via a coil spring 104. The inner sole 105 is formed with a number of ventilating openings 106. A guide-post 108 is fitted in the socket hole 107 formed on the shoe sole and supports the inner sole 105.

This related art is not suitable for a shoe to be worn for doing exercise, since the inner sole 105 moves upward and downward. FIG. 6 shows a structure of a shoe disclosed in U.S. Pat. No. 4,100,685.

The shoe sole 101 is formed with a number of venting channels 110 comprising through holes. The venting channel 110 is fitted with a filter insert 111.

In this related art, when foreign matter such as a pebble is caught in the lower portion 112 of the filter insert 111 of the venting channel 110, the foreign matter does not drop off, and is caught therein.

FIG. 7 shows a structure of a shoe disclosed in U.S. Pat. No. 4,507,880.

The shoe sole 101 is fitted with an air permeable member 120. The air permeable member 120 is formed with a number of ventilation through-holes 121.

In this related art, the ventilation through-holes 121 open on the bottom of the shoe sole 101. When small foreign matter such as a grain of sand is caught in the ventilation through-holes 121, the ventilation through-holes 121 can be clogged therewith.

SUMMARY OF THE INVENTION

Accordingly, it is an object of the present invention to prevent vent holes in a shoe sole from being clogged and to prevent the lowering of the air ventilating capability and the draining capability.

In order to achieve the object described above and others, the air ventilation structure of a shoe sole of the present invention is formed with a through hole vertically passing through the shoe sole. A ventilation part is slidably fitted into the through hole. The ventilation part comprises a flange portion and a projection. The flange portion engages with the upper surface of the shoe sole and is supported on such upper surface to prevent the ventilation part from dropping out of the through hole. The projection extends into the through hole partway. The projection is provided with a vent hole for the passage of air vertically therethrough.

When foreign matter such as a pebble enters from the bottom portion of the shoe sole and clogs the through hole therewith, the shoe sole is compressed when it is landed during exercise. In such a case, the ventilation part is not compressed. Therefore, the lower end of the ventilation part abuts against foreign matter, and the ventilation part pushes the foreign matter out downward, thereby preventing the through hole from being clogged.

In this way, according to the present invention, when foreign matter is caught in the through hole, it is pushed downward and out by the ventilation part when the sole is landed, and the foreign matter drops off. Therefore, there is little likelihood of the lowering of the air permeability and draining capability of the shoe sole.

In a preferred embodiment of the present invention, the through hole comprises a fitting hole portion defining the upper portion of the through hole for fitting the ventilation part therein, and a large diameter portion defining the lower portion of the through hole and having a larger hole diameter in comparison with the fitting hole portion. The projection passes through the fitting hole portion and extends into a part of the large diameter portion, so that the lower end of the projection faces toward an opening of the lower end of the large diameter portion.

In the preferred embodiment of the present invention, the large diameter portion is formed of a tapered portion which is gradually increased in hole diameter downward in a tapered shape, and the tapered portion opens downward.

According to this embodiment, the through hole gradually increases in hole diameter downward. Therefore, when the lower end of the ventilation part presses foreign matter from above after foreign matter is caught in the tapered portion, it can easily be dropped off.

In another preferred embodiment of the present invention, the upper surface of the shoe sole is formed with a fitting recess around the through hole corresponding to the shape of the flange portion.

According to this embodiment, by providing the fitting recess on the upper surface of the shoe sole, no irregularity is generated on the upper surface of the midsole, thereby improving comfortableness of the shoe.

DESCRIPTION OF THE PREFERRED EMBODIMENTS

Figure 1A:
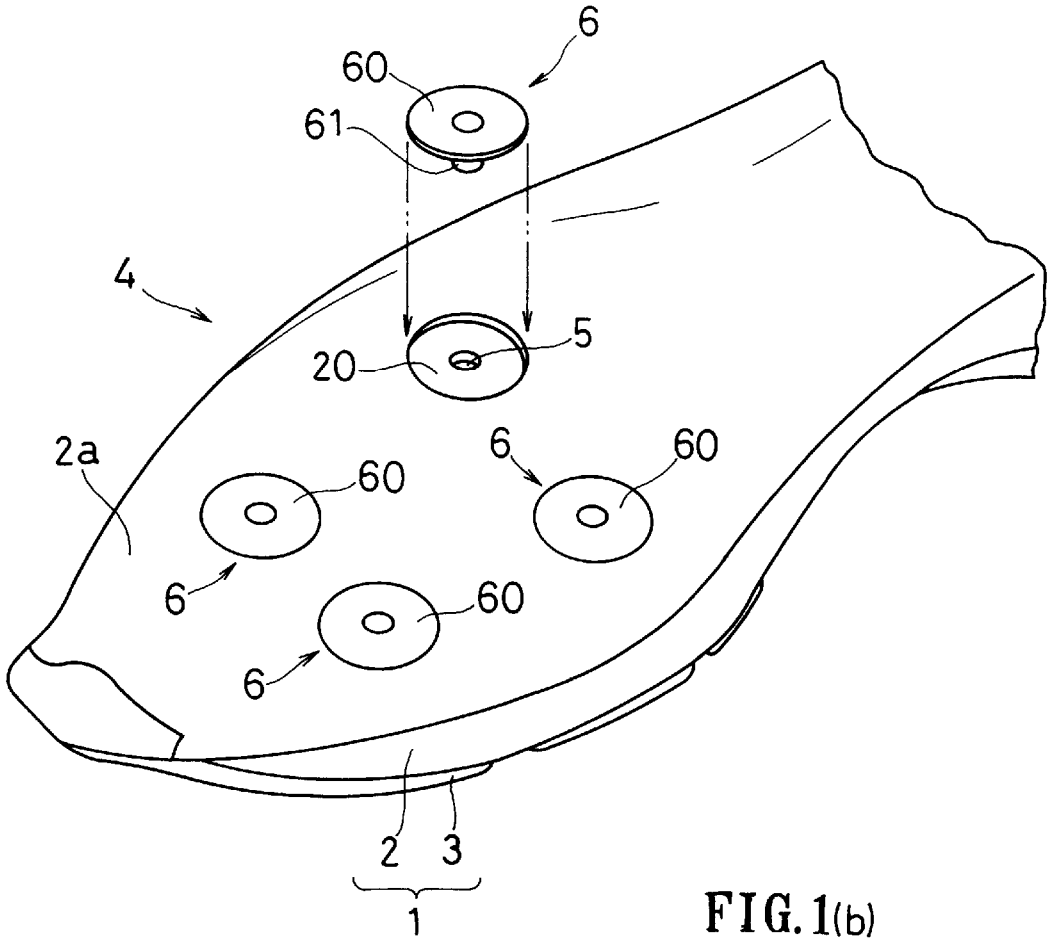
FIG. 1(*a*) is a perspective view showing the forefoot portion of the shoe sole according to an embodiment of the present invention, and FIG. 1(*b*) is an enlarged perspective view, partly exploded, of a ventilation part.

The present invention will be clearly understood from the description of preferred embodiments referring to attached drawings. However, the embodiments and drawings are only illustrative. The scope of the invention is defined by the appended claims. In the attached drawings, the same reference numerals designate the same or corresponding parts throughout drawings.

Figure 1B:
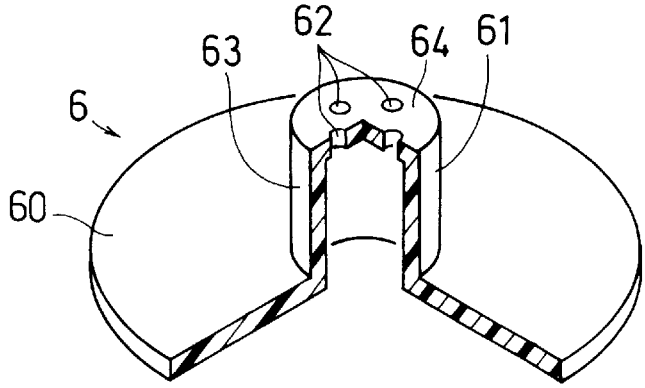

Referring now to FIG. 1(*a*)–FIG. 2(*b*), an embodiment of the present invention will be described.

In FIG. 1(*a*), the shoe sole 1 comprises a midsole 2 and an outsole 3 laminated. The forefoot portion (step-on portion) 4 of the shoe sole 1 has a ventilation structure as described below.

The shoe sole 1 is formed of a plurality of through holes 5 vertically passing through the shoe sole 1. The through hole 5 may be formed both on the midsole 2 and the outsole 3, and may be formed in such a manner that the outer sole 3 is divided into the front portion and the rear portion, or into the right portion and the left portion, so that the through hole 5 provided on the midsole 2 opens toward the bottom from the outer soles 3, 3. The respective through holes 5 is slidably fitted with a ventilation part 6.

Figure 2B:
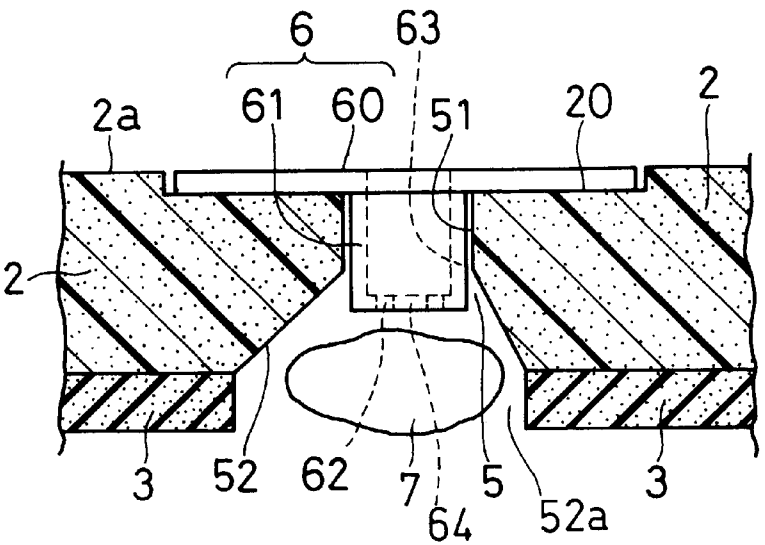
FIG. 2(*a*) and FIG. 2(*b*) are cross sectional views each showing a ventilation part and a through hole.
Figure 2A:
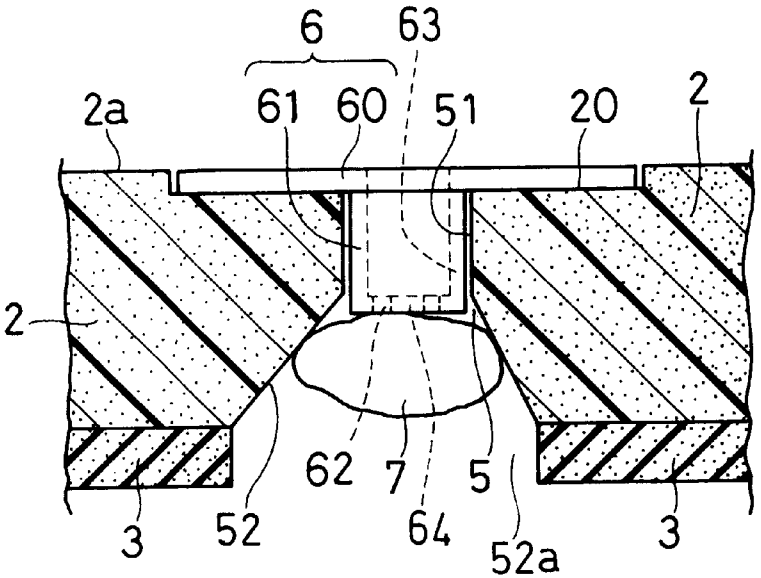

As shown in FIG. 2(*a*), the through hole 5 comprises a cylindrical fitting hole portion 51, and a tapered hole portion (large diameter portion) 52 of a truncated conical shape. While the fitting hole portion 51 defines the upper portion of the through hole 5, the tapered hole portion 52 defines the lower portion of the through hole 5. A projection 61 of the ventilation part 6 is fitted in the fitting hole portion 51 with only a slight clearance in-between the permit sliding therebetween. The tapered hole portion 52 is formed from the lower end of the fitting hole portion 51 continuously so as to increase gradually than the fitting hole portion 51 in hole diameter toward the bottom in a tapered shape. The tapered hole portion 52 opens toward the bottom, and has an opening 52*a* at the lower end.

As shown in FIG. 1(*b*), the ventilation part 6 is generally of the shape like a hat and comprises a flange portion 60 and a projection 61 which are integrally molded. The flange portion 60 is generally of the shape like a disk with the portion of the projection 61 opened. The projection 61 is formed into the shape of a cup and projects from the flange portion 60. The projection 61 includes a hollow cylindrical portion 63 and a disk portion 64 with a plurality of vent holes 62 formed therein. The disk portion 64 constitutes the tip (lower end) portion of the projection 61.

As shown in FIG. 2(*a*), the flange portion 60 engages with the upper surface 2*a* of the midsole 2 so that the ventilation part 6 does not drop off the through hole 5 downward. The projection 61 projects downward from the flange portion 60 and extends into the through hole 5 part way. In other words, the projection 61 does not pass through the through hole 5. The projection 61 passes through the fitting hole portion 51 and extends into a part of the tapered hole portion 52 toward the tapered hole portion 52. Therefore, the lower end of the projection 61 projects from the fitting hole portion 51 to some extent and faces toward the opening 52*a* on the lower end of the tapered hole 52.

The vent hole 62 on the projection 61 is vertically passed through the disk portion 64 for allowing air flow through the through hole 5. In other words, air containing moisture in the shoe is discharged through the vent hole 62, and outside air (fresh air) is introduced through the ventilation hole 62.

The upper surface 2*a* of the midsole 2 is formed with a shallow fitting recess 20 around the through hole 5. The shape of this fitting recess 20 corresponds to the shape of the flange portion 60 of the ventilation part 6, so that no irregularity is generated on the upper surface of the shoe sole 1 to prevent the comfortableness from lowering.

The ventilation part 6 is formed of an elastomer of thermoplastic resin, for example, such as polyamide and polyurethane. On the other hand, the midsole 2 is formed of a foam of resin such as EVA (ethylene-vinyl acetate copolymer) or polyurethane. The ventilation part 6 is formed of a material having a higher Young's modulus than the midsole 2.

When the shoe sole is landed with foreign matter 7 of FIG. 2(*a*) caught in the tapered hole portion 52 of the through hole 5, as shown in FIG. 2(*b*), the midsole 2 is compressed in the vertical direction. In this case, since the projection 61 of the ventilation part 6 is slidable with respect to the fitting hole portion 51, the ventilation part 6 is not compressed in the vertical direction. Accordingly, the extent of projection from the fitting hole portion 51 increases and the tip portion of the ventilation part 6 presses foreign matter 7 downward. Therefore, foreign matter 7 drops off the through hole 5, and thus clogging of the through hole 5 is prevented.

On the other hand, the through hole 5 has a free space at the lower end (distal end) of the projection 61, and thus there is no probability of catching small foreign matter such as a grain of sand in the vent hole 62 of the projection 61 when landed.

Figure 3A:
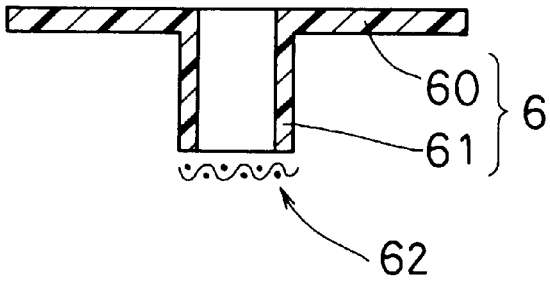
FIG. 3(*a*) and FIG. 3(*b*) are cross sectional views each showing a variant of a ventilation part.
Figure 3B:
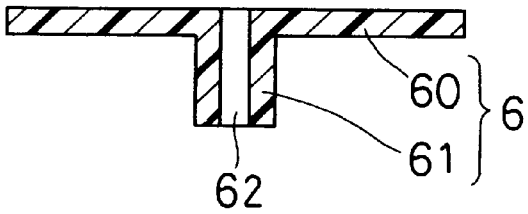
Figure 4:
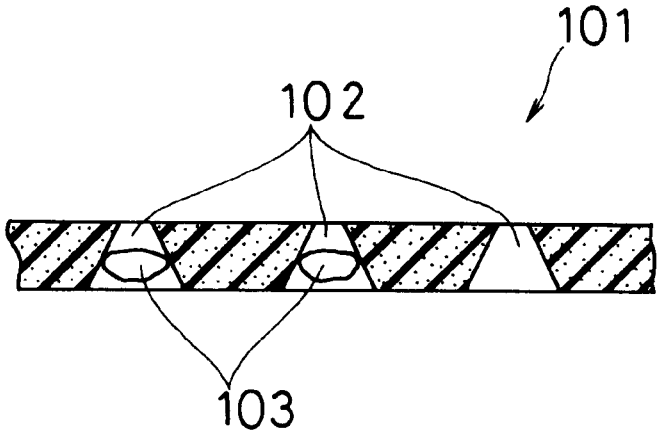
FIG. 4 PRIOR ART
FIG. 4 is a cross sectional view showing a structure of the shoe sole of the related art.
Figure 5:
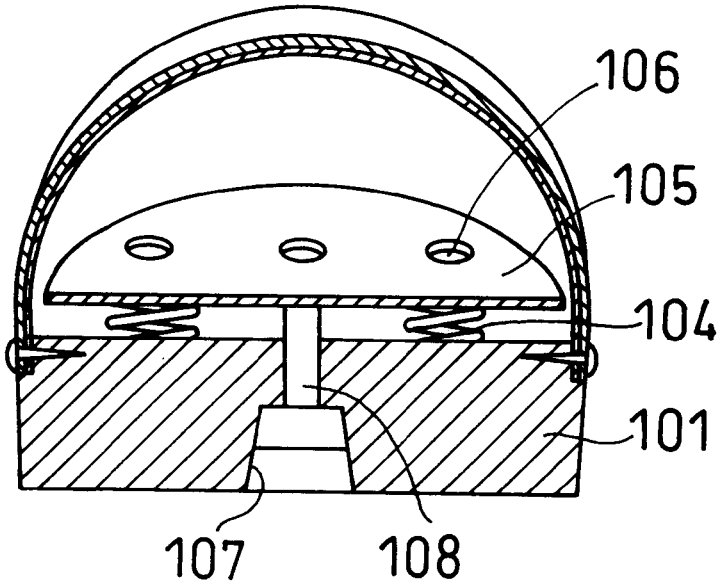
FIG.5 PRIOR ART
FIG. 5 is a lateral cross section showing a structure of the shoe disclosed in U.S. Pat. No. 904,891.
Figure 6:
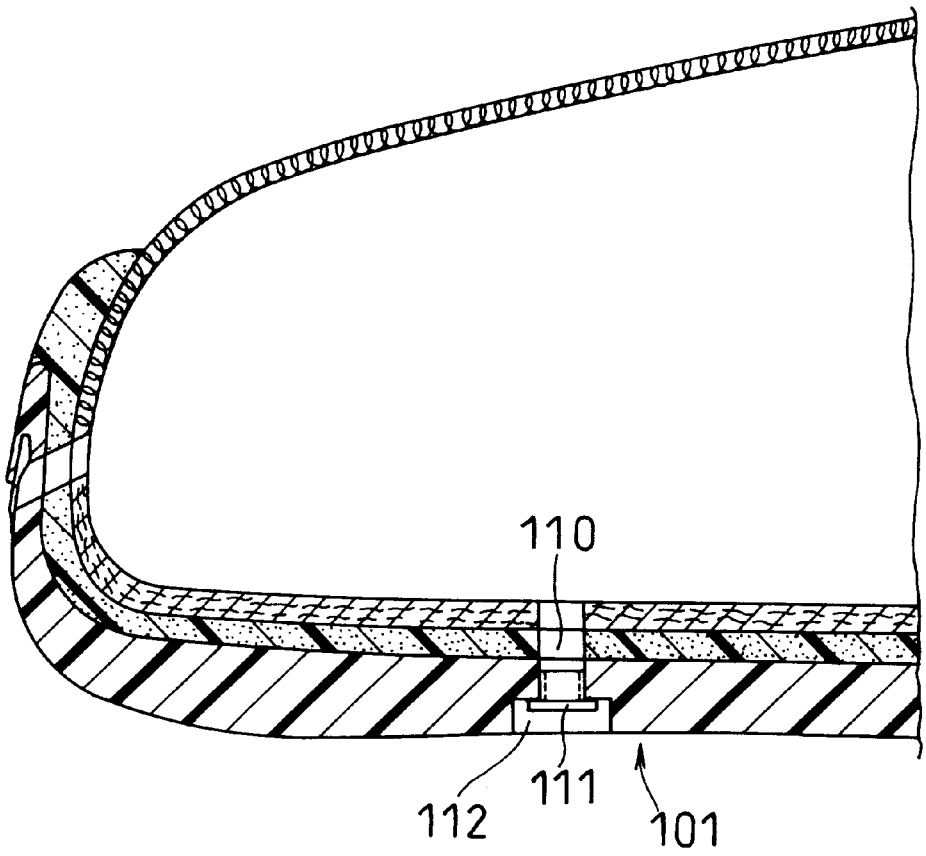
FIG. 6 PRIOR ART
FIG. 6 is a longitudinal cross section showing a part of the structure of the shoe disclosed in U.S. Pat. No. 4,100,685.
Figure 7:
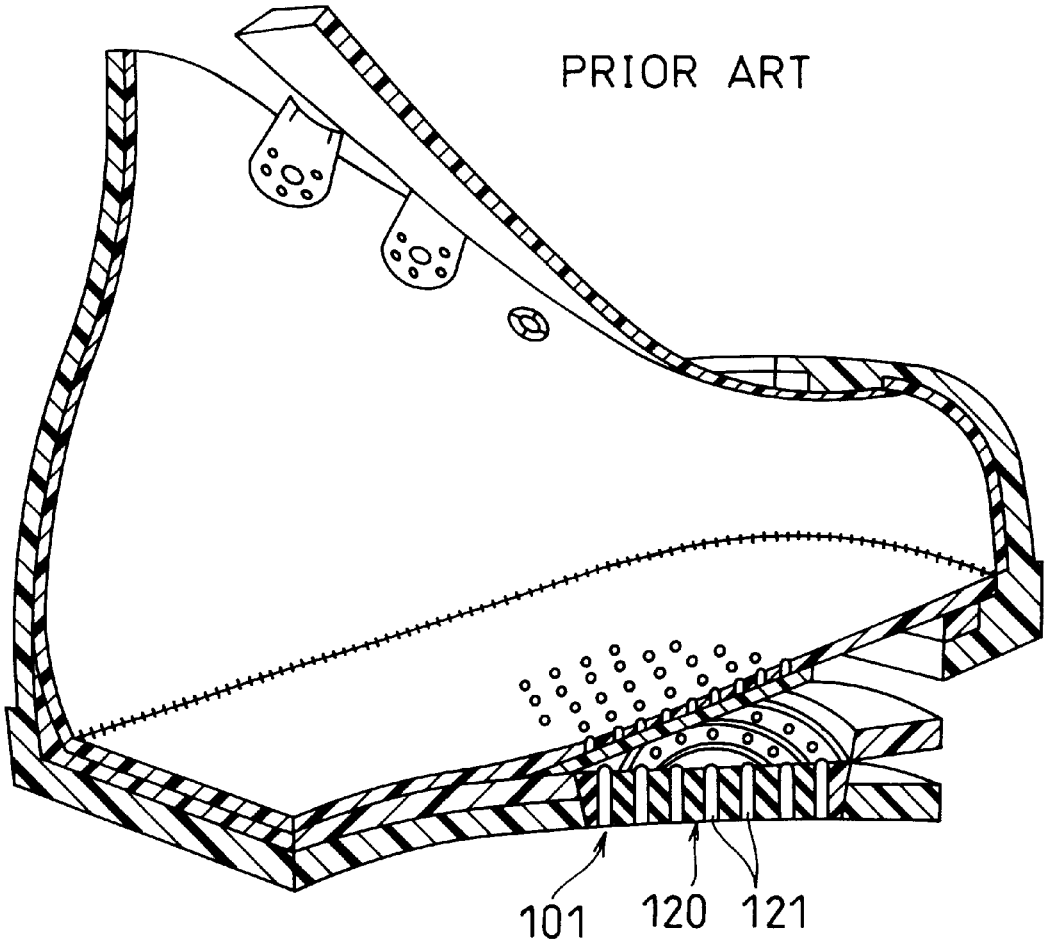
FIG. 7 PRIOR ART
FIG. 7 is a perspective view, partly exploded, showing a structure of the shoe disclosed in U.S. Pat. No. 4,507,880.

FIG. 3 shows a variant of the ventilation part 6.

As shown in FIG. 3(*a*), in the ventilation part 6, the vent hole 62 may be formed of mesh (reticulated body). Alternatively, as shown in FIG. 3(*b*), the ventilation pat 6 may be provided with a single vent hole 62.

As regards insole and sock lining, it is preferable to employ a ventilating material or a ventilating structure having a number of holes formed thereon.

While there has been described preferred forms of the invention, it will be obvious to those skilled in the art that various change and modification may be made in light of above teachings.

For example, the ventilation part may be formed of metal.

The configurations of the flange portion and the projection of the ventilation part are not restricted.

The shoe sole may be provided with a single through hole.

Therefore, such modifications and variations are understood to be contained within the invention defined by the appended claims.

What is claimed is:

1. A ventilation structure of a shoe sole for ventilating a space within the shoe, comprising:

a shoe sole including a through hole vertically passing through the shoe sole; and a ventilation part being fitted into the through hole;

the ventilation part comprising:

a flange portion engaging with an upper surface of the shoe sole so as to prevent the ventilation part from dropping out of the through hole; and a projection extending into the through hole partway; and the projection including a vent hole formed vertically through the projection for the passage of air;

wherein the through hole is provided in a portion of the shoe sole, the portion being compressed in the vertical direction when the shoe sole is landed;

the ventilation part is fitted into the through hole so that the projection of the ventilation part is slidable with respect to the through hole;

a top of the flange portion is placed so that when the shoe sole is landed pressure from above is applied to the top of the flange portion.

2. The ventilation structure of a shoe sole as set forth in claim 1, wherein the through hole comprises a fitting hole portion defining an upper portion of the through hole for fitting the ventilation part therein, and a large diameter portion defining a lower portion of the through hole and having a larger diameter in comparison with the fitting hole portion; and wherein the projection passes through the fitting hole portion and extends into a part of the large diameter portion and a lower end of the projection faces toward an opening of a lower edge of the large diameter portion.

3. The ventilation structure of a shoe sole as set forth in claim 2, wherein the large diameter portion is defined by a tapered hole portion that is gradually increased in hole diameter downward in a tapered shape, and wherein the tapered hole portion opens downward.

4. The ventilation structure of a shoe sole as set forth in claim 1, wherein the upper surface of the shoe sole is formed with a fitting recess around the through hole corresponding to the shape of the flange portion.

5. The ventilation structure of a shoe sole as set forth in claim 1, wherein the flange portion and the projection are integrally molded of an elastomer.

6. The ventilation structure of a shoe sole as set forth in claim 5, wherein the projection of the ventilation part comprises a hollow cylindrical portion and a disc portion formed with a plurality of vent holes.

7. The ventilation structure of a shoe sole as set forth in claim 5, wherein the ventilation part is formed of a material of which Young's modulus is larger than that of a midsole of the shoe sole.

8. The ventilation structure of a shoe sole as set forth in claim 1, wherein the projection and the through hole define a clearance therebetween, whereby the ventilation part is fitted into the through hole so that the projection of the ventilation part is slidable with respect to the through hole.

9. A ventilation structure of a shoe sole for ventilating a space within the shoe, comprising:

a shoe sole including a through hole vertically passing through the shoe sole; and a ventilation part being fitted into the through hole;

the ventilation part comprising:

a flange portion engaging with an upper surface of the shoe sole so as to prevent the ventilation part from dropping out of the through hole; and a projection extending into the through hole partway; and the projection including a vent hole formed vertically through the projection for the passage of air;

wherein the through hole comprises a fitting hole portion defining an upper portion of the through hole for fitting the ventilation part therein, and a large diameter portion defining a lower portion of the through hole and having a larger diameter in comparison with the fitting hole portion;

wherein the large diameter portion is defined by a tapered hole portion that is gradually increased in hole diameter downward in a tapered shape, and wherein the tapered hole portion opens downward; and wherein the projection passes through the fitting hole portion and extends into a part of the large diameter portion and a lower end of the projection faces toward an opening of a lower edge of the large diameter portion.

10. A ventilation structure of a shoe sole for ventilating a space within the shoe, comprising:

a shoe sole including a through hole vertically passing through the shoe sole; and a ventilation part being fitted into the through hole;

the ventilation part comprising:

a flange portion engaging with an upper surface of the shoe sole so as to prevent the ventilation part from dropping out of the through hole;

a projection extending into the through hole partway; and the projection including a vent hole formed vertically through the projection for the passage of air;

wherein the flange portion and the projection are integrally molded of an elastomer and the ventilation part is formed of a material having a Young's modulus greater than that of a midsole of the shoe sole.

* * * * *

UNITED STATES PATENT AND TRADEMARK OFFICE

CERTIFICATE OF CORRECTION

PATENT NO. : 6,467,191 B2
DATED : October 22, 2002
INVENTOR(S) : Hayashi, Tomohiro and Tanaka, Minoru It is certified that error appears in the above-identified patent and that said Letters Patent is hereby corrected as shown below:

Title page,
Item [73], Assignee, delete "AS/CS Corporation" and insert -- ASICS Corporation --.

Signed and Sealed this

Eighteenth Day of April, 2006

JON W. DUDAS
*Director of the United States Patent and Trademark Office*